United States Patent [19]

Miyao et al.

[11] 3,978,772

[45] Sept. 7, 1976

[54] PISTON SHOE FOR FLUID PRESSURE PUMP MOTOR

[75] Inventors: Takayuki Miyao; Hiroaki Maeda, both of Toyota; Masanori Sato, Nagoya, all of Japan

[73] Assignee: Aisin Seiki Kabushiki Kaisha, Kariya, Japan

[22] Filed: Feb. 19, 1974

[21] Appl. No.: 443,518

[30] Foreign Application Priority Data

Feb. 16, 1973 Japan ..... 48-19597

[52] U.S. Cl. ..... 92/158; 92/172; 92/188; 91/488; 91/499

[51] Int. Cl.[2] ..... F01B 31/10

[58] Field of Search ..... 91/488, 499; 92/12.2, 92/158, 172, 188; 403/141, 143

[56] References Cited

UNITED STATES PATENTS

| | | | |
|---|---|---|---|
| 2,638,850 | 5/1953 | Ferris | 91/488 |
| 2,674,196 | 4/1954 | Ferris | 92/157 |
| 2,880,042 | 3/1959 | Budzich | 91/488 |
| 3,283,725 | 11/1966 | Scott et al. | 91/488 |
| 3,726,189 | 4/1970 | Rubery | 91/506 |

FOREIGN PATENTS OR APPLICATIONS

| | | | |
|---|---|---|---|
| 242,606 | 2/1969 | U.S.S.R. | 92/172 |

*Primary Examiner*—William L. Freeh
*Assistant Examiner*—G. P. LaPointe
*Attorney, Agent, or Firm*—Oblon, Fisher, Spivak, McClelland & Maier

[57] ABSTRACT

A piston shoe for fluid pressure pump motors of the piston type is substantially disc-shaped and includes a concave portion provided upon one end face thereof for seating the convex portion of a piston rod associated with the piston and cylinder assemblies of the pump motor, while the other end face thereof is substantially flat for contacting the sliding surface of a swash plate. A holder or retainer is also provided in association with the shoe for retaining the piston rod within the concave seat, such retainer being secured to the shoe by biasing means, or alternatively by being pressed or crimped thereon.

6 Claims, 5 Drawing Figures

PISTON SHOE FOR FLUID PRESSURE PUMP MOTOR

BACKGROUND OF THE INVENTION

Field of the Invention

The present invention relates generally to piston shoes, and more particularly to a piston shoe for fluid pressure pump motors of the piston type.

SUMMARY OF THE INVENTION

An object of the present invention is to provide an improved piston shoe for fluid pressure pump motors of the piston type which is inexpensive to construct.

Another object of the present invention is to provide a new and simplified piston shoe for fluid pressure pump motors of the piston type.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference numerals designate like or corresponding parts throughout the several views and wherein.

DETAILED DESCRIPTION OF THE PREFERRED EMBODIMENTS

Figure 1:
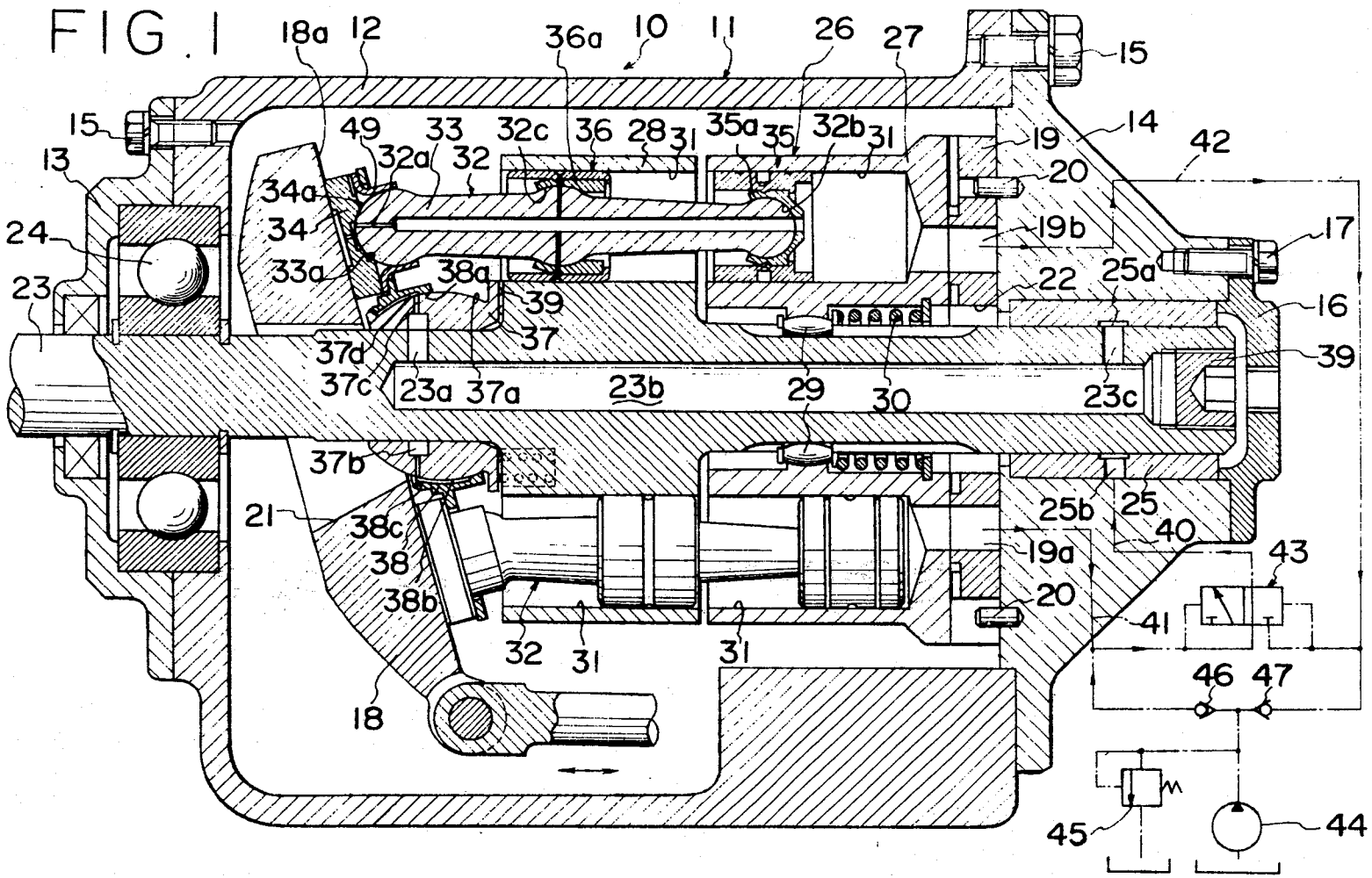
FIG. 1 is a schematic, partial sectional view of a fluid pressure pump motor of the piston type, utilizing the piston shoes of the present invention.

Referring now to the drawings, and more particularly to FIG. 1 thereof, a fluid pressure pump motor of the piston type is generally designated by the reference numeral 10 and is shown having a casing 11 which is constructed of three housings 12, 13, and 14 which are integrally mounted with housing 12 being disposed intermediate the end housings 13 and 14, by means of a plurality of bolts 15. A cover 16 is fixed at the outer end of the housing 14 by means of a plurality of bolts of which only one is shown representatively at 17. A swash plate 18 located within the inner left portion of the casing 11 is supported upon the casing 11 by means of a trunnion shaft, not shown, which is perpendicularly disposed to the plane of FIG. 1, and a valve plate 19 located within the inner right portion of the casing 11 is fixedly mounted upon the inner end of the housing 14 by means of a plurality of pins 20.

A rotating shaft 23 penetrates apertures 21 and 22, which are formed within the swash plate 18 and the valve plate 19, respectively, and is supported upon the casing 11 by means of bearings 24 and 25 disposed at both ends thereof. A cylinder body, generally indicated by the reference character 26 is arranged upon the rotating shaft 23 between the swash plate 18 and the valve plate 19 and is divided into two aligned portions 27 and 28, the portion 27 being in contact with the valve plate 19 and being swingably and axially movably secured upon the rotating shaft 23 by means of a plurality of pins 29 treated by crowning, and also being urged toward the valve plate 19 by means of a spring 30. The other portion 28 is integrally formed concentrically about the rotating shaft 23.

Figure 2:
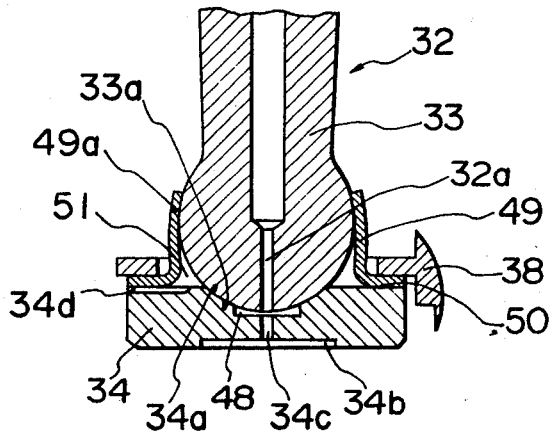
FIG. 2 is an enlarged view of a modification of the piston shoe of the present invention which may be used in the motor of FIG. 1.

A plurality of cylinders 31 are formed within the cylinder body 26 and are disposed in spaced circumferential relation about the shaft 23, and a similar number of pistons 32 are air-tightly and slidably inserted therewithin. A shoe 34 which slides upon a sliding surface **18*a* of the swash plate 18 is fixedly mounted upon the left end of a piston rod 33 associated with each piston 32, a convex portion 33*a* of the rod 33 being fitted within a concave portion 34*a* of the shoe 34, as best shown in FIG. 2. A piston head member 35 slidably disposed within the one portion 27 of the cylinder body 26 and another piston head member 36 slidably disposed within the other portion 28 thereof are respectively swingably connected with the rod 33 at the end thereof remote from the swash plate and at the middle portion thereof. A retainer 37 having a convex portion 37*a* is disposed at a position adjacent to the swash plate 18 and is connected to the rotating shaft 23 so as to axially slide thereon and to integrally rotate therewith in the same rotational direction thereof, a shoe retainer 38 having a concave portion 38*a* being disposed so as to receive the convex portion 37*a* of the retainer 37. The shoe retainer 38 receives the axial force of the swash plate and shaft assembly by means of a plurality of springs 39, disposed within a plurality of holes bored within the rotating shaft 23, through the retainer 37 and serves to pressedly hold the shoes 34 against the swash plate 18.**

An annular groove **37*b* is provided within the inner peripheral portion of the retainer holder 37, and a plurality of radially extending holes 37*c*, bored and extending from the groove 37*b* to the convex portion 37*a* of the retainer holder 37, are also provoded therein, while an annular groove 37*d* connecting with the respective opening end portions of the holes 37*c* is similarly provided upon the convex portion 37*a*. The arcuate extent of the concave portion 38*a* of the shoe retainer 38 is sufficient to cover the annular groove 37*d* even when the shoe retainer 38 is rotated upon and relative to the retainer 37 during the most inclined state of the swash plate 18 and a plurality of grooves 38*b* are provided upon the inner face of the concave portion 38*a* for always communicating with the annular groove 37*d*. A number of holes 38*c*, corresponding to the number of shoes 34, are also formed within one of the retainers 38 so as to be fluidically connected with one of the plurality of grooves 38*b*, holes 37*c* and 38*c* being provided with nozzles if desired. A radial hole 23*a* provided within shaft 23 also communicates with the annular groove 37*b* provided upon the inner peripheral portion of the retainer holder 37 and an axial bore 23*b* communicates with the passage 23*a*.**

A plug 52 is threadedly engaged within the right end portion of the rotating shaft 23 for preventing leakage of the lubricating oil from the bore **23*b*, and a radial passage 23*c* is provided within rotating shaft 23 at a position corresponding to the central portion of bearing 25 so as to be aligned with a similarly disposed annular groove 25*a* provided within bearing 25, while another radial passage 25***b* provides fluidic communication between the groove 25*a* and a passage 40 provided within the valve plate holder housing 14. A bore 19*a* provided within the lower portion of valve plate 19 serves as an inlet passage for the pump and motor operation of the present invention apparatus while a bore 19*b* provided within the upper portion of plate 19 serves as an outlet passage, the roles of such passages being reversed alternatively depending upon the pump or motor phase present, bore 19*a* being fluidly connected with a passage 41 while the bore 19*b* is similarly connected with a passage 42, also provided within housing 14.

Still referring to FIG. 1, a three-port two-position changeover valve 43 is also provided within the fluid circuit, two ports thereof being respectively connected with the passages 41 and 42 while the remaining port is connected with the passage 40. This three-port two-position changeover valve 43 is shifted, from the high pressure side to the low pressure side depending upon the respective pressures within passages 41 and 42, by means of a pilot pressure obtained from the passages 41 and 42, whereby communication between the passages 41 and 42 is alternately made with the passage 40.

A pump 44 serves for charging the circuit with fluid, and a predetermined pressure upon the low pressure side is regulated by means of a regulator valve 45, pump 44 being in communication with the passages 41 and 42 through means of check valves 46 and 47, respectively, whereby the fluid pressure is applied only to the passage 41 or 42 associated with the low pressure side, such pressure then being transmitted to the piston 32 and cylinder 31 assemblies.

Referring now to FIG. 2, the shoe 34 is seen to support the axial thrust imparted thereto by the fluid pressure force acting upon the piston 32 by means of the operation of the static pressure bearing thereof, which includes a pocket 34*b* disposed upon the face of shoe 34 disposed against the sliding surface 18*a* of the swash plate 18 and an axial orifice 34*c* for supplying the fluid pressure to the pocket 34*b* from another axial passage 32*a* formed within the inner portion of the piston 32, an oil saving portion 48 being interposed between passages 32*a* and 34*c* for supplying fluid pressure from the passage 32*a* to the pocket 34*b* through means of the orifice 34*c*, even when the swash plate 18 is inclined so as to change the thrusting capacity of the fluid pressure pump and motor.

A retainer 49 serves to retain piston rod 33 seated upon shoe 34, and the retainer 49 and shoe 34 are in turn held in contact iwth each other along a surface 50 by means of the shoe retainer 38 axially urged thereagainst by means of the plurality of springs 39. By caulking an end portion 49*a* of the holder 49 to the convex portion 33*a* of the rod 33, the release of the piston 32 from the holder 49 during the operation of the fluid pressure pump and motor is prevented, the convex portion 33*a* of the rod 33 being of course retained within the concave portion 34*a* of the shoe 34 by means of the axial force imparted through means of the shoe retainer 38 and the springs 39 to holder 49 and shoe 34, the piston 32 and the shoe 34 therefore not being released from each other during operation of the fluid pressure pump and motor. The hydraulic fluid contained within a chamber 51 and supplied from the oil saving portion 48 through means of the sliding surface between the convex portion 33*a* of the rod 33 and the concave portion 34*a* of the shoe 34 is discharged therefrom by means of a radially extending groove 34*d* provided within the surface of shoe 34 which is in abutment with holder 49, it also being readily understood that the groove 34*d* may alternatively be provided upon the retainer 49.

The operation of the present invention will now be described. Upon the pump operation of the pump motor, the rotating shaft 23 is driven by means of a prime mover, not shown, and the cylinder body 26 is similarly rotated therewith. In the event that the swash plate 18 is inclined with respect to the vertical direction as shown in FIG. 1, the pistons 32 are slidably moved upon the sliding surface 18*a* of the swash plate 18 via the shoes 34 and are slidably moved in the axial direction with respect to the cylinder body 26, fluid pressure being sucked from passage 19*a* and being discharged into the passage 19*b* whereupon the pumping operation is attained. Therefore, the fluid pressure associated with the passage 41 becomes low pressure while the fluid pressure associated with the passage 42 becomes high pressure, the high pressure fluid of the passaage 42 of cource being communicated to a suitable fluid pressure actuating system, not shown, whereby such fluid supplied serves as a fluid pressure source therefor.

When the fluid pressure within the passage 41 becomes low pressure and the fluid pressure within the passage 42 high pressure, the three-port two-position changeover valve 43 is disposed within the state shown in FIG. 1 whereby the passages 41 and 40 are in communication with each other. As the passage 41 becomes low pressure, however, the check valve 46 is opened by means of the fluid pressure from the charging pump 44, the fluid pressure regulated by means of the regulator valve 45 then being provided within the passage 41, the check valve 47 of course being closed at this time due to the high pressure within the passage 42. The fluid pressure discharged from the charging pump 44 and supplied to passage 41 is supplied to the suction port 19*a* as well as to the passage 40, the fluid pressure being supplied to the latter passage being in turn transmitted to the groove 38*b* of the shoe retainer 38 through means of the passage 25*b*, the annular groove 25*a*, the bores 23*c*, 23*b*, and 23*a*, the annular groove 37*b*, the passage 37*c* and the annular groove 37*d*.

The contacting surface between the shoe retainer 38 and the retainer 37 is thus lubricated by means of the fluid supplied to the groove 38*b* of the shoe retainer 38 and furthermore, the sliding surface 18*a* of plate 18 in contact with the shoe 34 is similarly lubricated and cooled through means of fluid passing through the hole 38*c* under centrifugal force due to rotation of the shaft assembly. At this time, the annular groove 37*d* is so constructed as to be located within the groove 38*b*, even if the shoe retainer 38 is shifted upon the retainer 37, and consequently, the above fluid pressure is discharged after lubrication of the contacting surface between the shoe retainer 38 and the retainer 37 and of the sliding surface 18*a* of the swash plate 18. The fluid pressure supplied to the groove 38*b* of the shoe retainer 38 is positively supplied from the aperture 38*c* to the inner peripheral end portion of the sliding surface 18*a* of the swash plate 18 no deleterious effects upon the apparatus occurring as a result of such centrifugal force lubrication.

Continuing further, high pressure fluid from another fluid pressure source, not shown, may be supplied to the passage 41 for pump motor operation whereby the rotating shaft 23 becomes a driven shaft. At this time, the fluid pressure within the passage 41 becomes high pressure while the fluid pressure within passage 42 becomes low pressure whereupon the three-port two-position changeover valve 43 is shifted from the state of FIG. 1 to the state whereby the passages 42 and 40 are fluidly connected. In consequence thereof, the fluid pressure is supplied to the sliding surface between the shoe retainer 38 and the retainer 37 as well as the inner peripheral end portion of the sliding surface 18*a* of the swash plate 18 from the pump 44 via the passages 42 and 40, such sliding surface and inner peripheral end portion being lubricated and cooled in a manner similar to that noted hereinbefore.

Figure 3:
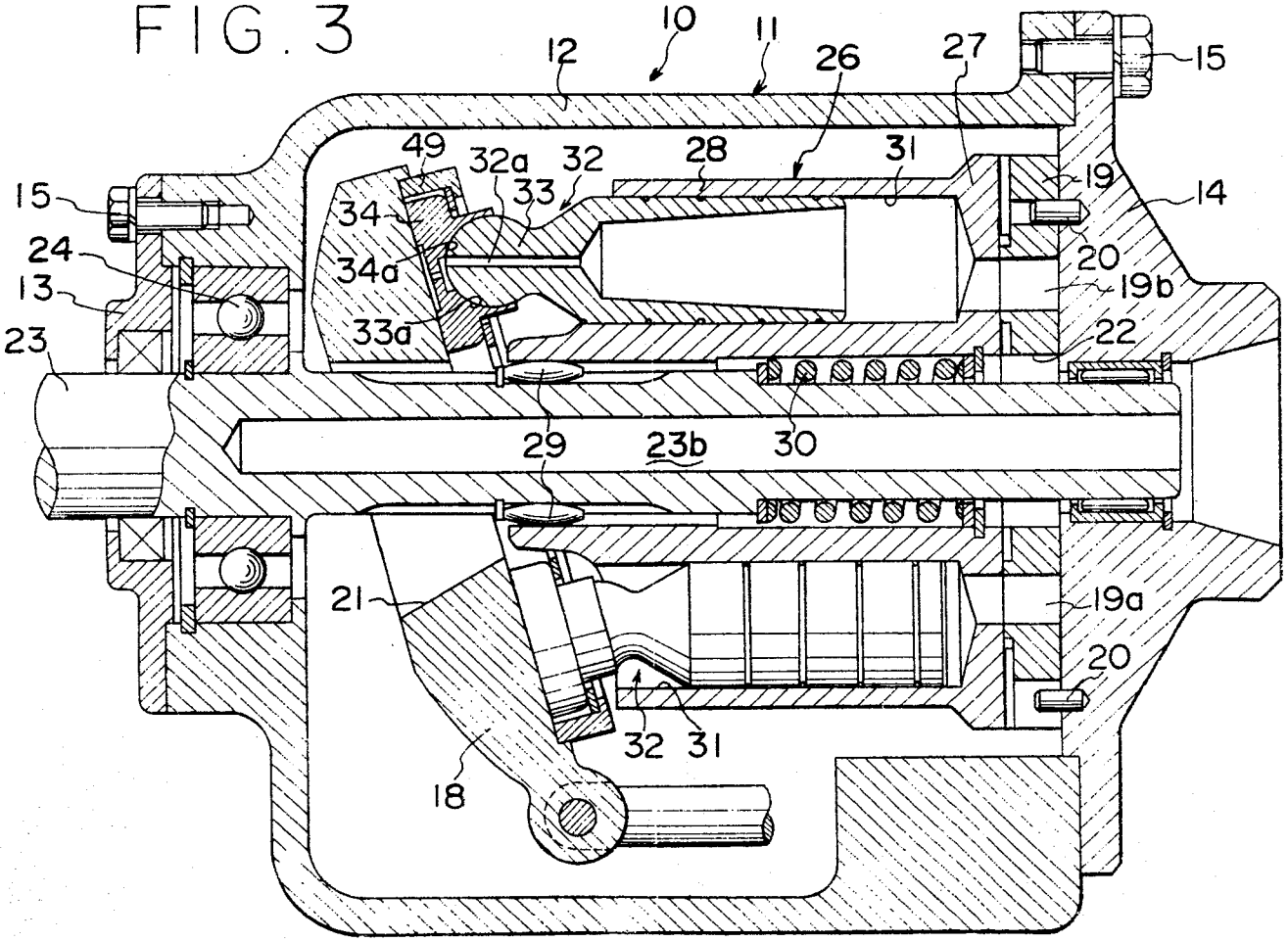
FIG. 3 is a view similar to that of FIG. 1, illustrating, however, a fluid pressure pump motor of the piston type utilizing conventional piston shoes.

Referring now to FIG. 3 which discloses a pump-motor assembly utilizing conventional piston shoes, the piston shoe 34 is seen to be provided with a small diameter portion and a large diameter portion, and the convex portion 33*a* of the piston rod 33 of the piston 32 is supported by means of the small diameter portion of the piston shoe 34 which is disposed about the ball portion of rod 33 so as to rotatably secure the same therewithin, the large diameter portion of the piston shoe 34 being in contact with the swash plate 18. The pocket 34*b* of the piston shoe 34 is fluidly connected with the port 19*b* of the valve plate 19 through means of the orifice 34*c* of the piston shoe 34, the passage 32*a* of the piston 32, and the cylinders 31 of the cylinder body 26, whereby piston shoe 34 has the function of the static pressure bearing.

As noted heretofore, most of the conventional piston shoes 34 are produced by cutting operations performed upon members having simple columnar configurations. Such cutting operations however waste material, and in addition, the high accuracy required for producing the concave portion 34*a* of the piston shoe 34 for contact with the outer surface of the convex portion 33*a* of the rod 33 is not readily attainable whereby high productivity is not readily achieved and the cost of the product is substantially increased.

Figure 4:
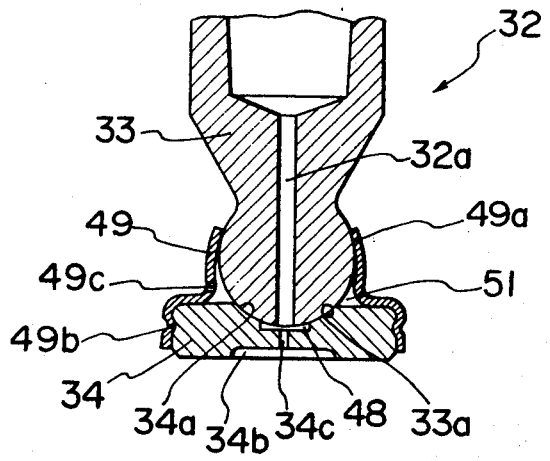
FIG. 4 is a view similar to that of FIG. 2, illustrating, however, a further modification of the piston shoe of the present invention.
Figure 5:
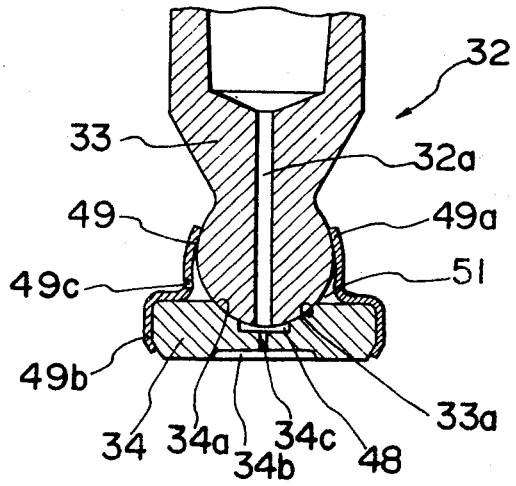
FIG. 5 is a view similar to that of FIG. 2, illustrating, however, yet a further modification of the present shoe of the piston invention.

Referring next to FIGS. 4 and 5 showing other embodiments of the present invention, the convex portion 33*a* of the piston rod 33 is covered by means of the end portion 49*a* of the retainer 49 while the other end portion 49*b* of the holder 49 is fixedly mounted upon the piston shoe 34 whereby the release of the convex portion 33*a* of the rod 33 from the piston shoe 34 is prevented. In assembling such components, the diameter of the end portion 49*b* of the holder 49 is chosen so as to be able to cover the piston shoe 34, the piston shoe 34 then being inserted within the end portion 49*b* of the holder 49, and thereafter a wall portion of the end portion 49*b* of the holder 49 is pressed into the piston shoe 34 by means of a punch, or alternatively, the diameter of the end portion 49*b* of the holder 49 is crimped, as best seen from FIG. 5, the assembly of the piston shoe 34 and the holder 49 fixedly retained thereon resulting. Furthermore, without extending the diameter of the end portion 49*b* of the holder 49, such may be constructed as having a flange portion provided upon the end portion 49*b* of the holder 49 for connection with the piston shoe 34, this flange portion being subsequently welded.

The convex portion 33*a* of the rod 33 is then inserted within the holder 49 whereupon the end portion 49*a* of the holder 49 is now crimped so as to provide contact between the convex portion 33*a* of the rod 33 and the concave portion 34*a* of the piston shoe 34 through means of the contact between the end portion 49*a* of the holder 49 and the convex portion 33*a* of the rod 33. An aperture 49*c* of the holder serves for discharging the leaked fluid pressure. A light bearing material, such as for example, A1-S alloy is suitable for the piston shoe 34 while a material, such as for example, duralumin, is suitable for the holder.

Obviously, many modifications and variations of the present invention are possible in light of the above teachings. It is to be understood therefore, that within the scope of the appended claims, the present invention may be practiced otherwise than as specifically described herein.

What is claimed as new and desired to be secured by Letters Patent of the United States is:

1. A piston shoe for fluid pressure pump motors of the piston type, comprising:

a substantially flat, plate-type shoe having a concave portion, for seating a convex portion of a piston rod, defined within one end surface therof and a substantially planar portion for contacting a sliding surface of a swash plate at the other end thereof;

a malleable holder capable of being worked so as to have a configuration corresponding to that of said convex portion of said piston and thereby support, and be caulked to, said convex portion of said piston rod at one end thereof, said holder being separate from, yet capable of being worked so as to have a configuration corresponding to that of said shoe and thereby be relatively immovably held in contacting relation with said shoe at the other end thereof; and discharging means defined within said shoe for discharging the hydraulic fluid within a chamber defined by said shoe, said holder, and said piston.

2. A piston shoe for fluid pressure pump motors of the piston type as set forth in claim 1 wherein said holder is relatively immovably held in contacting relation with said shoe by a biasing means operatively connected with said holder and supporting said shoe and said piston rod through means of said holder.

3. A piston shoe for fluid pump motors of the piston type as set forth in claim 1 wherein said discharging means is a groove.

4. A piston shoe for fluid pressure pump motors of the piston type as set forth in claim 1, wherein said other end of said holder is caulked to said shoe for holding said holder in relative immovable and contacting relation with said shoe.

5. A piston shoe for fluid pressure pump motors of the piston type as set forth in claim 1, wherein said other end of said holder is crimped so as to be connected to said shoe.

6. A piston shoe for fluid pressure pump motors of the piston type as set forth in claim 1, wherein said other end of said holder is pressed into said shoe so as to be connected thereto.

* * * * *